US006525517B1

(12) United States Patent
Hojo et al.

(10) Patent No.: US 6,525,517 B1
(45) Date of Patent: Feb. 25, 2003

(54) POWER SUPPLY CIRCUIT WITH A SOFT STARTING CIRCUIT

(75) Inventors: Yoshiyuki Hojo, Kyoto (JP); Yoshihisa Hiramatsu, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/979,086

(22) PCT Filed: Jul. 7, 2000

(86) PCT No.: PCT/JP00/04576

§ 371 (c)(1),
(2), (4) Date: Nov. 19, 2001

(87) PCT Pub. No.: WO01/04721

PCT Pub. Date: Jan. 18, 2001

(30) Foreign Application Priority Data

Jul. 13, 1999 (JP) ..... 11/199260
Jun. 28, 2000 (JP) ..... 2000-193756

(51) Int. Cl.[7] ..... G05F 3/16
(52) U.S. Cl. ..... 323/316; 323/901; 323/908
(58) Field of Search ..... 323/908, 901, 323/274, 275, 276, 277, 316; 361/23, 18, 93.1, 93.7

(56) References Cited

U.S. PATENT DOCUMENTS 4,611,154 A * 9/1986 Lambropoulos et al. .... 318/434
6,188,210 B1 * 2/2001 Tichauer et al. ..... 323/273

FOREIGN PATENT DOCUMENTS

JP 6-163803 6/1994
JP 10-293617 11/1998

* cited by examiner

*Primary Examiner*—Shawn Riley
(74) *Attorney, Agent, or Firm*—Rader, Fishman & Grauer PLLC

(57) ABSTRACT

A power supply device has a soft starting circuit 12, which is composed of a transistor Tr9 having its emitter connected to the emitter of a transistor Tr1 of which the base serves as a non-inverting input terminal of a comparator 11 and having its collector grounded, a clamp circuit 10 connected between the base of the transistor Tr1 and the base of the transistor Tr9, a constant-current source 7 receiving a supply voltage Vcc through a switch 2, a capacitor Cs having one end connected to the base of the transistor Tr9 and having the other end grounded, a switch 9 connected to the capacitor Cs, having its contact "c" connected to the constant-current source 7, and having its contact "d" connected to a discharge circuit 8, and the discharge circuit 8.

19 Claims, 6 Drawing Sheets

POWER SUPPLY CIRCUIT WITH A SOFT STARTING CIRCUIT

TECHNICAL FIELD

The present invention relates to a power supply device such as a series regulator or a constant-voltage power supply, and to a semiconductor integrated circuit device constituting such a power supply device.

BACKGROUND ART

FIG. 6 shows a circuit diagram showing the internal configuration of a conventionally used power supply device. This conventional power supply device is composed of switches 1 and 2, constant-current sources 3, 4, and 5 and a resistor R1 to which a supply voltage Vcc is applied through the switch 2, pnp-type transistors Tr1, Tr2, Tr3, Tr6, and Tr8, npn-type transistors Tr4, Tr5, and Tr7, an output terminal 6, and resistors R2 and R3 for dividing the output voltage appearing at the output terminal 6.

The transistor Tr1 has its base connected to the switch 1, has its emitter connected to the constant-current source 3, and has its collector grounded. The transistors Tr2 and Tr3 have their emitters connected to the constant-current source 4, have their bases connected respectively to the emitters of the transistors Tr1 and Tr6, and have their collectors connected respectively to the collectors of the transistors Tr4 and Tr5. The transistors Tr4 and Tr5 have their emitters grounded, and have their bases connected together. The transistor Tr4 has its collector connected to its base, and the transistor Tr5 has its collector connected to the base of the transistor Tr7.

The transistor Tr6 has its emitter connected to the constant-current source 5, has its base connected to the node between the resistors R2 and R3, and has its collector grounded. The transistor Tr7 has its collector connected to the resistor R1, and has its emitter grounded. The transistor Tr8 receives at its emitter the supply voltage Vcc through the switch 2, has its base connected to the resistor R1, and has its collector connected to the output terminal 6. The resistor R2 is connected to the output terminal 6, and the resistor R3 is grounded. When the switch 1 is switched to its contact "a," the base of the transistor Tr1 is grounded, and, when the switch 1 is switched to its contact "b," a voltage VBG is applied to the base of the transistor Tr1. Furthermore, to the output terminal 6, a capacitor Co is connected that provides phase compensation capacitance. The capacitor Co is grounded at the other end.

In this power supply device configured as described above, the constant-current sources 3, 4, and 5 and the transistors Tr1, Tr2, Tr3, Tr4, Tr5, and Tr6 together constitute a comparator 11, with the base of the transistor Tr1 serving as a non-inverting input terminal, the base of the transistor Tr6 serving as an inverting input terminal, and the node between the collectors of the transistors Tr3 and Tr5 serving as an output terminal. That is, the comparator 11 receives, at its non-inverting input terminal, the voltage VBG through the switch 1 and, at its inverting input terminal, a voltage obtained by dividing the output voltage appearing at the output terminal 6 with the resistors R2 and R3, thereby forming a negative feedback circuit.

In this power supply device, when the switch 2 is closed, the supply voltage Vcc is applied to the constant-current sources 3, 4, and 5, to the resistor R1, and to the emitter of the transistor Tr8. Simultaneously, the switch 1 is switched to its contact "b," so that the input voltage VBG is applied to the base of the transistor Tr1. Making the base voltage of the transistor Tr1 equal to VBG in this way brings the transistor Tr1 into a non-conducting state. This reduces the current flowing from the base of the transistor Tr2 to the emitter of the transistor Tr1, and thus makes the emitter current of the transistor Tr3 larger than the emitter current of the transistor Tr2. On the other hand, the transistors Tr4 and Tr5 together constitute a current mirror circuit, and therefore the collector current s of the transistors Tr4 and Tr5 are equal to the emitter current of the transistor Tr2.

As a result, a current flows from the comparator 11 to the base of the transistor Tr7. This base current causes an amplified current to flow through the transistor Tr7 as its collector current, and the resulting voltage drop across the resistor R1 causes the base voltage of the transistor Tr8 to drop. Thus, an emitter current starts flowing through the transistor Tr8, delivering an output voltage Vo to the output terminal 6.

In this way, the power supply device configured as shown in FIG. 6 outputs the output voltage Vo via its output terminal 6. Here, the output voltage Vo takes several milliseconds to rise, and therefore a start-up charge current (hereinafter referred to as the "inrush current") as large as 1 A or more flows through the capacitor Co. This inrush current flows to the limit of the current capacity of the output transistors of the power supply device, and therefore, in a case where the output current rises abruptly, as in the conventional power supply device under discussion, the heat accompanying the large inrush current may degrade the characteristics of, or even destroy, the power supply device. Moreover, for example, in a case where the source of the supply voltage Vcc is of a DC/DC type, the rush current causes a drop in the supply voltage Vcc, and is thus likely to cause start-up failure in all circuits that are used in parallel with the power supply device.

DISCLOSURE OF THE INVENTION

An object of the present invention is to provide a power supply device provided with a soft starting function whereby the voltage that is fed in at start-up is increased gradually so that the output voltage rises gradually in order to reduce the inrush current at start-up.

To achieve the above object, according to claim 1, a power supply device that controls an output voltage from an output circuit by comparing a monitoring voltage, which is obtained by dividing the output voltage, with a reference voltage by means of a comparator and keeping the monitoring voltage equal to the reference voltage on the basis of a comparison output from the comparator comprises a soft starting circuit that, at star-up, outputs a gradually increasing voltage and shuts off the reference voltage until the gradually increasing voltage reaches a predetermined voltage higher than the reference voltage.

In this power supply device, at the start-up thereof, the voltage output from the soft starting circuit increases gradually until it reaches the predetermined voltage, and, until this voltage output from the soft starting circuit reaches the redetermined voltage, the reference voltage fed to the comparator is shut off. This makes the voltage fed to the comparator vary gradually, and thereby suppresses the transient response of the output voltage from the output circuit at start-up.

BEST MODE FOR CARRYING OUT THE INVENTION

FIRST EMBODIMENT

Figure 1:
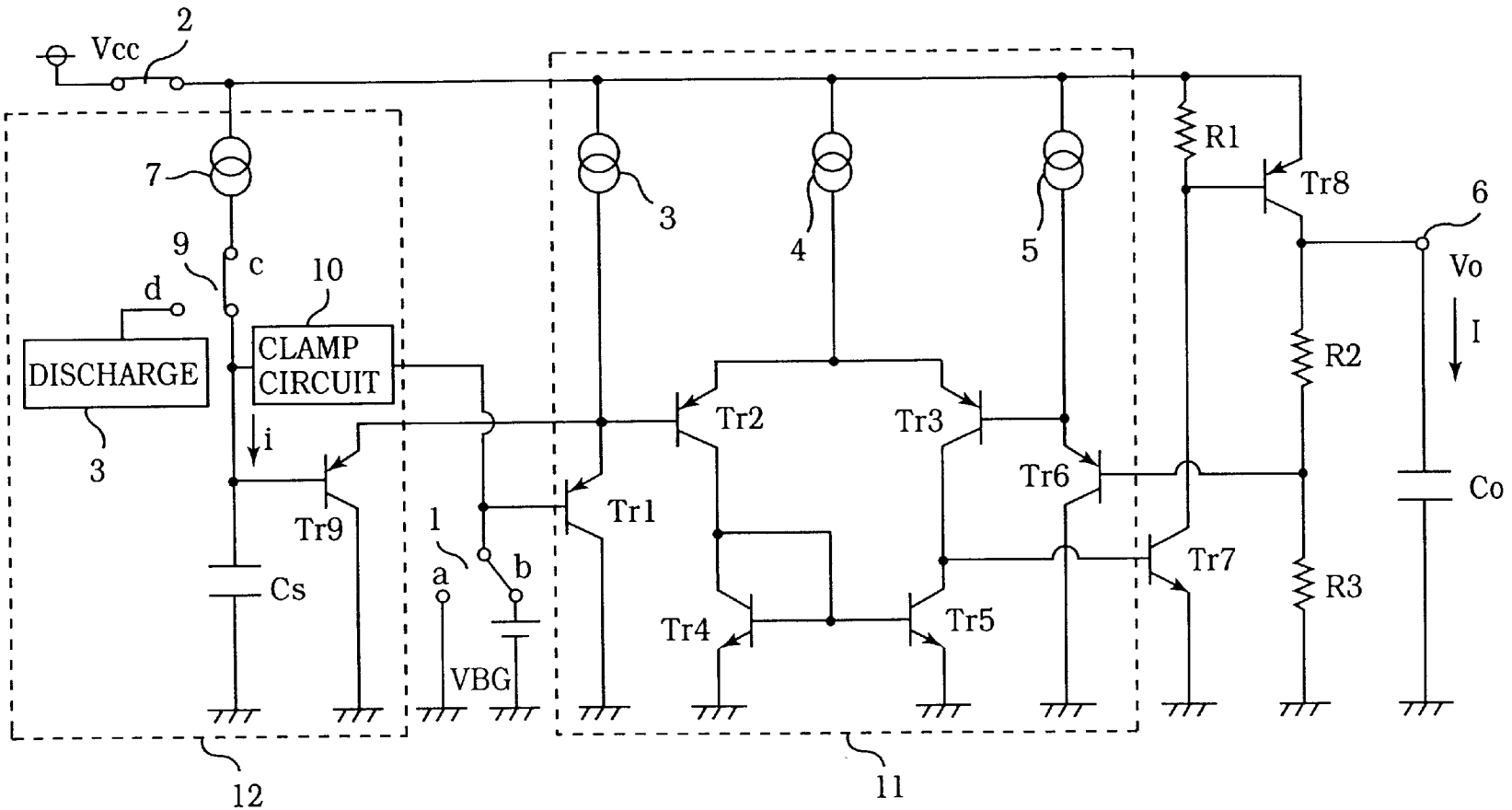
FIG. 1 is a circuit diagram showing the internal configuration of the power supply device of a first embodiment of the invention.

A first embodiment of the invention will be described below with reference to the drawings. FIG. 1 is a circuit diagram showing the internal configuration of the power supply device of this embodiment. In the power supply device shown in FIG. 1, such circuit elements and blocks as find their counterparts in the power supply device shown in FIG. 6 are identified with the same reference numerals or symbols, and their detailed explanations will not be repeated.

The power supply device shown in FIG. 1 is a modified version of a power supply device composed of pnp-type transistors Tr1, Tr2, Tr3, Tr6, and Tr8, npn-type transistors Tr4, Tr5, and Tr7, resistors R1, R2, and R3, switches 1 and 2, constant-current sources 3, 4, and 5, and an output terminal 6. Specifically, the modification consists in providing this power supply device additionally with a constant-current source 7 to which the supply voltage Vcc is applied through the switch 2, a pnp-type transistor Tr9, a capacitor Cs, a discharge circuit 8, a switch 9, and a clamp circuit 10.

The transistor Tr9 has its emitter connected to the emitter of the transistor Tr1, has its base connected to the capacitor Cs, and has its collector grounded. The capacitor Cs is grounded at one end, and is connected to the switch 9 at the other end. The switch 9 has its contact "c" connected to the constant-current source 7, and has its contact "d" connected to the discharge circuit 8. The clamp circuit 10 is connected between the base of the transistor Tr9 and the base of the transistor Tr1. Moreover, as in the power supply device shown in FIG. 6, to the output terminal 6 is connected a capacitor Co that provides phase compensation capacitance and of which the other end is grounded.

Figure 6:
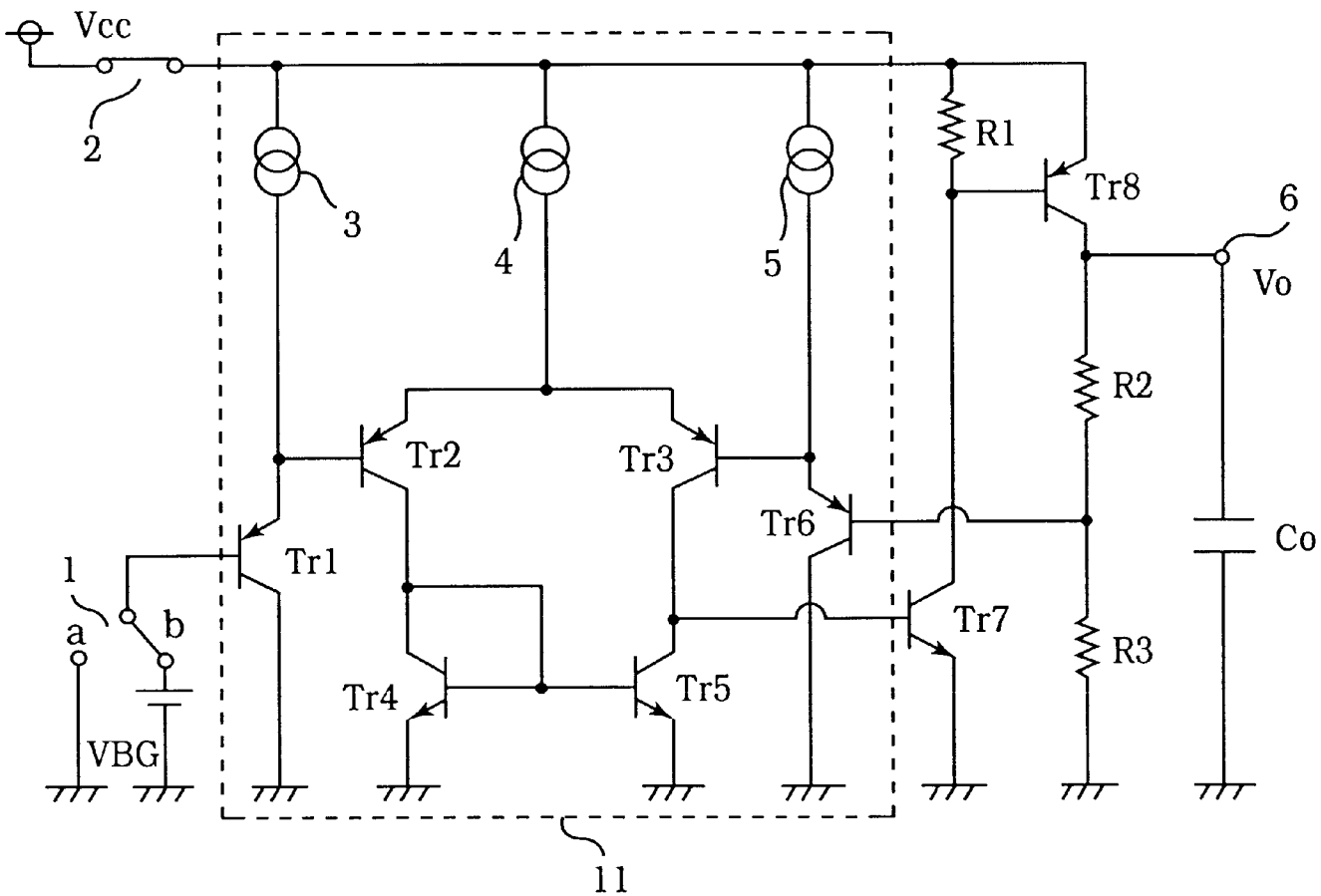
FIG.6 PRIOR ART
FIG. 6 is a circuit diagram showing the internal configuration of a conventional power supply device.

As in the power supply device shown in FIG. 6, the transistors Tr1, Tr2, Tr3, Tr4, Tr5, and Tr6 and the constant-current sources 3, 4, and 5 together constitute a comparator 11. Moreover, the constant-current source 7, the discharge circuit 8, the switch 9, the clamp circuit 10, the transistor Tr9, and the capacitor Cs together constitute a soft starting circuit 12.

How this power supply device configured as described above operates will be described below. Here, it is assumed that the switch 9 has already been switched to its contact "d" to discharge the capacitor Cs, and thus that the power supply device is now in an initial state. In this state, first, the switch 9 is switched to its contact "c," the switch 1 is switched to its contact "b," and the switch 2 is closed. It is to be noted that the marking "ON" shown in FIG. 2 (indicating that the power supply device is on) refers to the state in which the switches 1, 2, and 9 are in the positions described just above, and that the marking "OFF" shown in FIG. 2 (indicating that the power supply device is off) refers to the state in which the switches 1, 2, and 9 are in just the opposite positions. Moreover, in FIG. 2(*a*), the broken line represents the level of the supply voltage, and the solid line represents the level of the output voltage Vo. Furthermore, in FIG. 2(*b*), the broken line represents the base voltage of the transistor Tr1, and the solid line represents the base voltage of the transistor Tr9.

As a result, the supply voltage Vcc is applied to the constant-current sources 3, 4, 5, and 7, to the resistor R1, and to the emitter of the transistor Tr8, and the voltage VBG is applied to the base of the transistor Tr1. Moreover, since the switch 9 is switched to its contact "c," a current flows from the constant-current source 7 to the capacitor Cs, charging the capacitor Cs. In this way, at the moment when the aforementioned switches are so switched as to switch the power supply device from the initial state to the on state, as FIG. 2(*b*) shows, the base voltage of the transistor Tr9 equals zero. This brings the transistor Tr9 into a conducting state, making the base voltage of the transistor Tr2 equal to VBE (where VBE represents the base-to-emitter voltage of the transistor Tr9).

Figure 2:
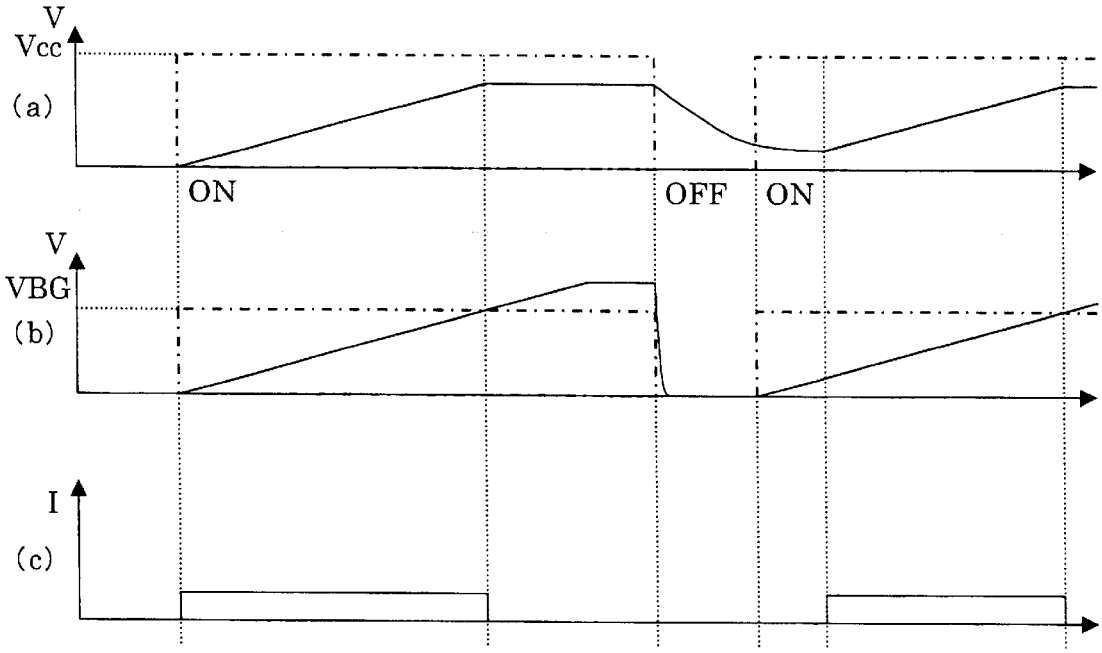
FIG. 2 is a time chart showing the voltages observed at relevant points in the power supply device shown in FIG. 1.

On the other hand, as FIG. 2(*a*) shows, when the voltage output via the output terminal 6 equals zero, the voltages fed to the bases of the transistors Tr1 and Tr6 are equal. Thereafter, as the capacitor Cs is charged, the base voltage of the transistor Tr9 increases gradually, and thus the emitter voltage of the transistor Tr9 increases gradually. As a result, the base voltage of the transistor Tr2 becomes higher than the base voltage of the transistor Tr3, and thus the emitter current of the transistor Tr2 becomes smaller than the emitter current of the transistor Tr3.

The collector currents of the transistors Tr4 and Tr5 are equal to the emitter current of the transistor Tr2, and therefore the output current from the comparator 11 flows through the transistor Tr7. This output current causes an amplified current to flow through the transistor Tr7 as its collector current, and the resulting voltage drop across the resistor R1 causes the base voltage of the transistor Tr8 to drop. Thus, a current commensurate with the voltage drop across the resistor R1 flows through the transistor Tr8 as its emitter current, and this emitter current flows through the resistors R2 and R3, producing the output voltage Vo.

Here, as FIG. 2(*b*) shows, the base voltage of the transistor Tr9 increases gradually, and thus the base voltage of the transistor Tr2 increases gradually, with the result that the base current of the transistor Tr7 increases gradually. Thus, as FIG. 2(*a*) shows, according to the base voltage of the transistor Tr9, the output voltage Vo also increases gradually. When the base voltage of the transistor Tr9, increasing in this way, becomes higher than the voltage VBG, the emitter current of the transistor Tr1 becomes larger than the emitter current of the transistor Tr9, so that the base voltage of the transistor Tr2 is determined by the transistor Tr1.

Now that the base voltage of the transistor Tr2 is determined by the transistor Tr1, the base voltage of the transistor Tr2 becomes constant. As a result, the output current that flows through the transistor Tr7 becomes constant, and thus, as FIG. 2(*a*) shows, the output voltage Vo becomes constant. On the other hand, the current from the constant-current source 7 tends to continue flowing through the capacitor Cs, but the clamp circuit 10 limits the base voltage of the transistor Tr9 so that it does not become higher than a predetermined level, and thus the charging of the capacitor Cs is stopped, with the result that, as FIG. 2(*b*) shows, the base voltage of the transistor Tr9 also becomes constant at the predetermined level.

The clamp circuit 10 is realized with a pnp-type transistor having its emitter connected to the base of the transistor Tr9, having its base connected to the base of the transistor Tr1, and having its collector grounded. Specifically, if it is assumed that the base-to-emitter voltage of the transistor used in the clamp circuit 10 is VBE, when the base voltage of the transistor Tr9 becomes equal to VBG+VBE, the current that tends to flow from the constant-current source 7 to the capacitor Cs is diverted to flow through the transistor of the clamp circuit 10. Thus, the charging of the capacitor Cs is stopped, and the base voltage of the transistor Tr9 is held at VBG+VBE.

As described heretofore, when the power supply device is turned on, as FIG. 2(*a*) shows, the output voltage Vo increases gradually as the base voltage of the transistor Tr9 increases gradually, until it becomes constant after the base voltage of the transistor Tr9 has exceeded the voltage VBG. The time τ that elapses before the output voltage Vo becomes constant is given by the formula below, in which Cs represents the capacitance of the capacitor Cs, and i represents the current with which the capacitor Cs is charged.

$$\tau = Cs \times VBG / i$$

Thus, on the basis of the time τ calculated according to this formula, it is possible to calculate the charge current I that flows through the capacitor Co according to the formula below, in which Co represents the capacitance of the capacitor Co, and Vmax represents the level at which the output voltage Vo is held when it becomes constant.

$$I = Co \times V\max / \tau$$

According to this formula, the charge current I becomes smaller as the time τ becomes longer, and therefore, to keep the charge current I not more than ten times as large as the output current in steady-state operation, the time τ needs to be set within the range from about 100 milliseconds to about several tens of milliseconds. This time τ can be made longer either by making the capacitance of the capacitor Cs higher or by making the charge current i flowing from the constant-current source 7 smaller. By lengthening the time that the output voltage requires to rise in this way, it is possible to keep the charge current at start-up sufficiently small, specifically not more than ten times as large as the output current in steady-state operation. Hereinafter, the charge current at start-up of which the level is determined in this way is referred to as the "start-up charge current." As FIG. 2(*c*) shows, this start-up charge current I flows while the output voltage Vo is rising.

Then, after the output voltage Vo has become constant, the switch 1 is switched to its contact "a," the switch 9 is switched to its contact "d," and the switch 2 is opened in order to turn off the power supply device. Here, the discharge circuit 9 discharges the capacitor Cs so that, as FIG. 2(*b*) shows, the base voltage of the transistor Tr9 becomes equal to zero. Moreover, the capacitor Co is discharged through the resistors R2 and R3, with the result that, as FIG. 2(*a*) shows, the output voltage Vo becomes lower.

Thereafter, when the switches 1, 2, and 9 are again so switched as to turn on the power supply device, the transistor Tr9 operates just in the same manner as described earlier so that, as FIG. 2(*b*) shows, its base voltage increases gradually until, when it exceeds VBG+VBE, it becomes constant. Here, if it is assumed that, as FIG. 2(*a*) shows, the output voltage Vo has not fallen fully down to zero, the base voltage of the transistor Tr3 remains higher than the base voltage of the transistor Tr2, and therefore no base current flows in the transistor Tr7. Thus, the capacitor Co is discharged through the resistors R2 and R3, and the output voltage Vo continues falling. Thereafter, when the base voltage of the transistor Tr2 becomes higher than the base voltage of the transistor Tr3, the same operation as described earlier is performed again so that, as FIG. 2(*a*) shows, the output voltage Vo starts rising. Eventually, when the base voltage of the transistor Tr9 exceeds VBG, the output voltage Vo becomes constant.

In the example specifically described above, the clamp circuit 10 is realized with a pnp-type transistor; however, it may be realized with any other type of device as long as it operates in a similar manner. The discharge circuit 8 is realized with, for example, a resistor of which one end is connected to the contact "d" of the switch 9 and of which the other end is grounded; however, it may be realized with any other circuit configuration. The power supply device described above may be formed as a single-chip semiconductor integrated circuit device; in that case, if the capacitor Cs is fitted externally, it is possible to vary its capacitance and thereby adjust the magnitude of the start-up charge current.

SECOND EMBODIMENT

Figure 3:
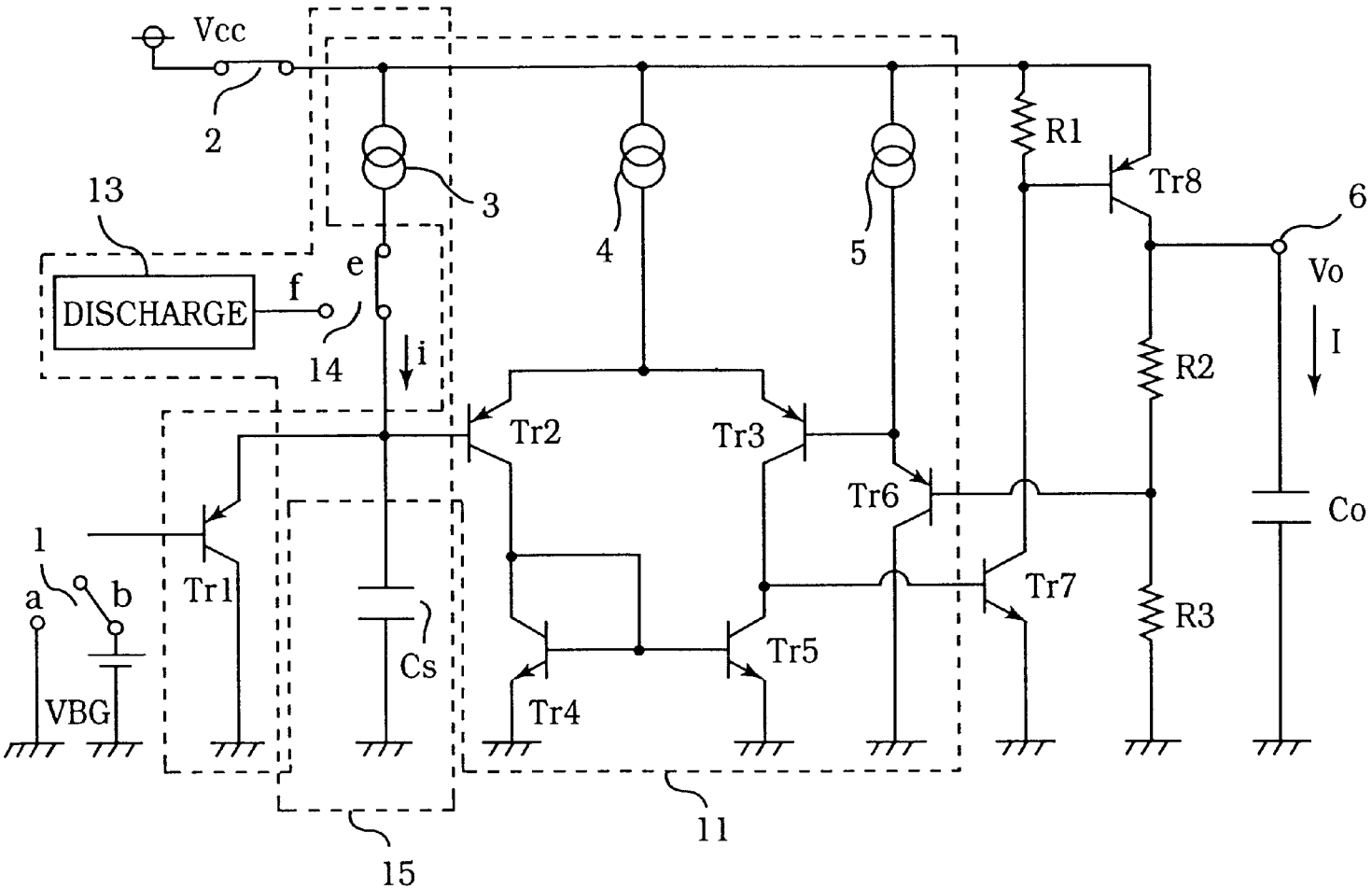
FIG. 3 is a circuit diagram showing the internal configuration of the power supply device of a second embodiment of the invention.

A second embodiment of the invention will be described below with reference to the drawings. FIG. 3 is a circuit diagram showing the internal configuration of the power supply device of this embodiment. In the power supply device shown in FIG. 3, such circuit elements and blocks as find their counterparts in the power supply device shown in FIG. 6 are identified with the same reference numerals or symbols, and their detailed explanations will not be repeated.

The power supply device shown in FIG. 3 is a modified version of a power supply device composed of pnp-type transistors Tr1, Tr2, Tr3, Tr6, and Tr8, npn-type transistors Tr4, Tr5, and Tr7, resistors R1, R2, and R3, switches 1 and 2, constant-current sources 3, 4, and 5, and an output terminal 6. Specifically, the modification consists in providing this power supply device additionally with a capacitor Cs, a discharge circuit 13, and a switch 14.

The capacitor Cs is grounded at one end, and is connected, at the other end, to the node between the emitter of the transistor Tr1 and the base of the transistor Tr2. The switch 14 is connected to the node between the emitter of the transistor Tr1 and the base of the transistor Tr2, has its contact "e" connected to the constant-current source 3, and has its contact "f" connected to the discharge circuit 13. Moreover, as in the power supply device shown in FIG. 6, to the output terminal 6 is connected a capacitor Co that provides phase compensation capacitance and of which the other end is grounded.

As in the power supply device shown in FIG. 6, the transistors Tr1, Tr2, Tr3, Tr4, Tr5, and Tr6 and the constant-current sources 3, 4, and 5 together constitute a comparator 11. Moreover, the constant-current source 3, the discharge circuit 13, the switch 14, and the capacitor Cs together constitute a soft starting circuit 15.

How this power supply device configured as described above operates will be described below. Here, it is assumed that the switch 14 has already been switched to its contact "f" to discharge the capacitor Cs, and thus that the power supply device is now in an initial state. In this state, first, the switch 14 is switched to its contact "e," the switch 1 is switched to its contact "b," and the switch 2 is closed. It is to be noted that the marking "ON" shown in FIG. 4

Figure 4:
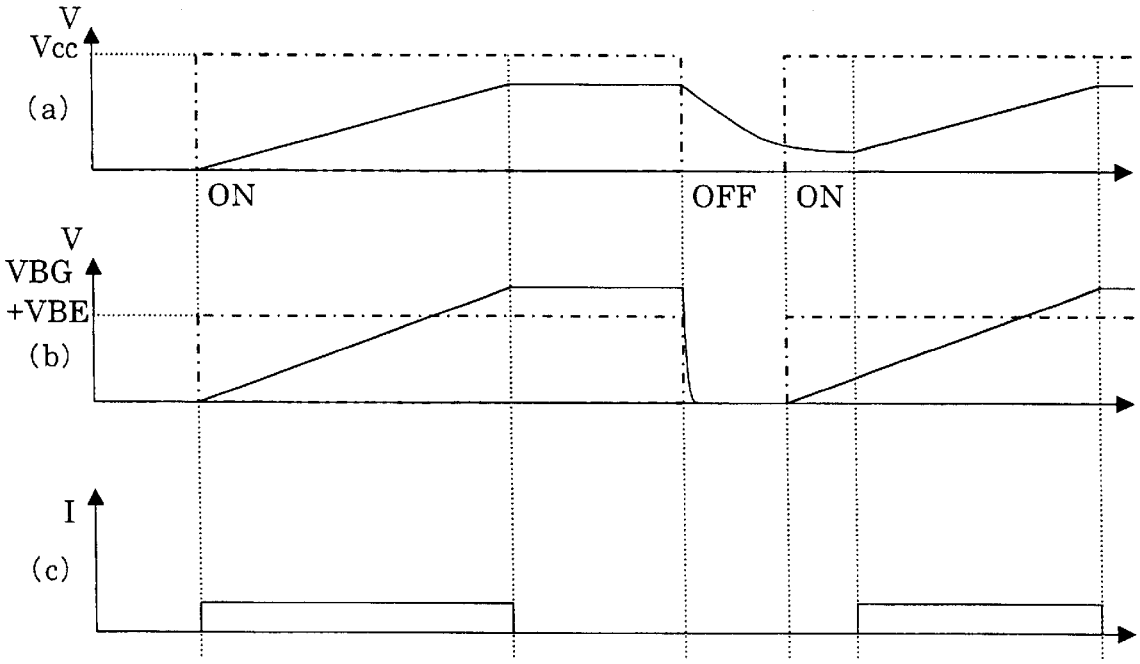
FIG. 4 is a time chart showing the voltages observed at relevant points in the power supply device shown in FIG. 3.

(indicating that the power supply device is on) refers to the state in which the switches 1, 2, and 14 are in the positions described just above, and that the marking "OFF" shown in FIG. 4 (indicating that the power supply device is off) refers to the state in which the switches 1, 2, and 14 are in just the opposite positions. Moreover, in FIG. 4(*a*), the broken line represents the level of the supply voltage, and the solid line represents the level of the output voltage Vo. Furthermore, in FIG. 4(*b*), the broken line represents the base voltage of the transistor Tr1, and the solid line represents the base voltage of the transistor Tr2.

As a result, the supply voltage Vcc is applied to the constant-current sources 3, 4, and 5, to the resistor R1, and to the emitter of the transistor Tr8, and the voltage VBG is applied to the base of the transistor Tr1. Moreover, since the switch 14 is switched to its contact "e," a current flows from the constant-current source 3 to the capacitor Cs, charging the capacitor Cs. In this way, at the moment when the aforementioned switches are so switched as to switch the power supply device from the initial state to the on state, as FIG. 4(*b*) shows, the base voltage of the transistor Tr2 equals zero; that is, the base of the transistor Tr2 is grounded.

Moreover, as FIG. 4(*a*) shows, the voltage output via the output terminal 6 is equal to zero. This brings the transistor Tr6 into a conducting state, and thereby causes the base of the transistor Tr3 to be grounded. Thus, the voltages fed to the transistors Tr2 and Tr3 become equal. Thereafter, as the capacitor Cs is charged, the base voltage of the transistor Tr2 increases gradually. As a result, the base voltage of the transistor Tr2 becomes higher than the base voltage of the transistor Tr3, and thus the emitter current of the transistor Tr2 becomes smaller than the emitter current of the transistor Tr3.

The collector currents of the transistors Tr4 and Tr5 are equal to the emitter current of the transistor Tr2, and therefore the output current from the comparator 11 flows through the transistor Tr7. This output current causes an amplified current to flow through the transistor Tr7 as its collector current, and the resulting voltage drop across the resistor R1 causes the base voltage of the transistor Tr8 to drop. Thus, a current commensurate with the voltage drop across the resistor R1 flows through the transistor Tr8 as its emitter current, and this emitter current flows through the resistors R2 and R3, producing the output voltage Vo.

Here, as FIG. 4(*b*) shows, the base voltage of the transistor Tr2 increases gradually, and thus the base current of the transistor Tr7 increases gradually. Thus, as FIG. 4(*a*) shows, according to the base voltage of the transistor Tr2, the output voltage Vo also increases gradually. When the base voltage of the transistor Tr2, increasing in this way, becomes higher than VBG+VBE (where VBE represents the base-to-emitter voltage of the transistor Tr1), the transistor Tr1 conducts, and thus an emitter current starts flowing through the transistor Tr1, with the result that, as FIG. 4(*b*) shows, the base voltage of the transistor Tr2 becomes constant at VBG+VBE.

When the base voltage of the transistor Tr2 becomes constant in this way, the output current that flows through the transistor Tr7 becomes constant, and thus, as FIG. 4(*a*) shows, the output voltage Vo becomes constant. As described heretofore, when the power supply device is turned on, as FIG. 4(*a*) shows, the output voltage Vo increases gradually as the base voltage of the transistor Tr2 increases gradually, until it becomes constant after the base voltage of the transistor Tr2 has exceeded the voltage VBG+VBE. The time τ that elapses before the output voltage Vo becomes constant is given by the formula below, in which Cs represents the capacitance of the capacitor Cs, and i represents the current with which the capacitor Cs is charged.

$$\tau = Cs \times (VBG + VBE)/i$$

Thus, on the basis of the time τ calculated according to this formula, it is possible to calculate the start-up charge current I that flows through the capacitor Co according to the formula below, in which Co represents the capacitance of the capacitor Co, and Vmax represents the level at which the output voltage Vo is held when it becomes constant.

$$I = Co \times V\max/\tau$$

According to this formula, the start-up charge current I becomes smaller as the time τ becomes longer, and therefore, to keep the charge current I not more than ten times as large as the output current in steady-state operation, the time τ needs to be set within the range from about 100 milliseconds to about several tens of milliseconds. This time τ can be made longer either by making the capacitance of the capacitor Cs higher or by making the charge current i flowing from the constant-current source 3 smaller. By lengthening the time that the output voltage requires to rise in this way, it is possible to keep the start-up charge current at start-up sufficiently small, specifically not more than ten times as large as the output current in steady-state operation. This start-up charge current I flows while the output voltage Vo is rising.

Then, after the output voltage Vo has become constant, the switch 1 is switched to its contact "a," the switch 14 is switched to its contact "f," and the switch 2 is opened in order to turn off the power supply device. Here, the discharge circuit 13 discharges the capacitor Cs so that, as FIG. 4(*b*) shows, the base voltage of the transistor Tr2 becomes equal to zero. Moreover, the capacitor Co is discharged through the resistors R2 and R3, with the result that, as FIG. 4(*a*) shows, the output voltage Vo becomes lower.

Thereafter, when the switches 1, 2, and 14 are again so switched as to turn on the power supply device, the transistor Tr2 operates just in the same manner as described earlier so that, as FIG. 4(*b*) shows, its base voltage increases gradually until, when it exceeds VBG+VBE, it becomes constant. Here, if it is assumed that, as FIG. 4(*a*) shows, the output voltage Vo has not fallen fully down to zero, the base voltage of the transistor Tr3 remains higher than the base voltage of the transistor Tr2, and therefore no base current flows in the transistor Tr7. Thus, the capacitor Co is discharged through the resistors R2 and R3, and the output voltage Vo continues falling. Thereafter, when the base voltage of the transistor Tr2 becomes higher than the base voltage of the transistor Tr3, the same operation as described earlier is performed again so that, as FIG. 4(*a*) shows, the output voltage Vo starts rising. Eventually, when the base voltage of the transistor Tr2 exceeds VBG+VBE, the output voltage Vo becomes constant.

The discharge circuit 13 is realized with, for example, a resistor of which one end is connected to the contact "f" of the switch 14 and of which the other end is grounded; however, it may be realized with any other circuit configuration. The power supply device described above may be formed as a single-chip semiconductor integrated circuit device; in that case, if the capacitor Cs is fitted externally, it is possible to vary its capacitance and thereby adjust the magnitude of the start-up charge current.

In the first and second embodiments, the comparator is configured as shown in FIGS. 1 and 3, respectively.

Figure 5:
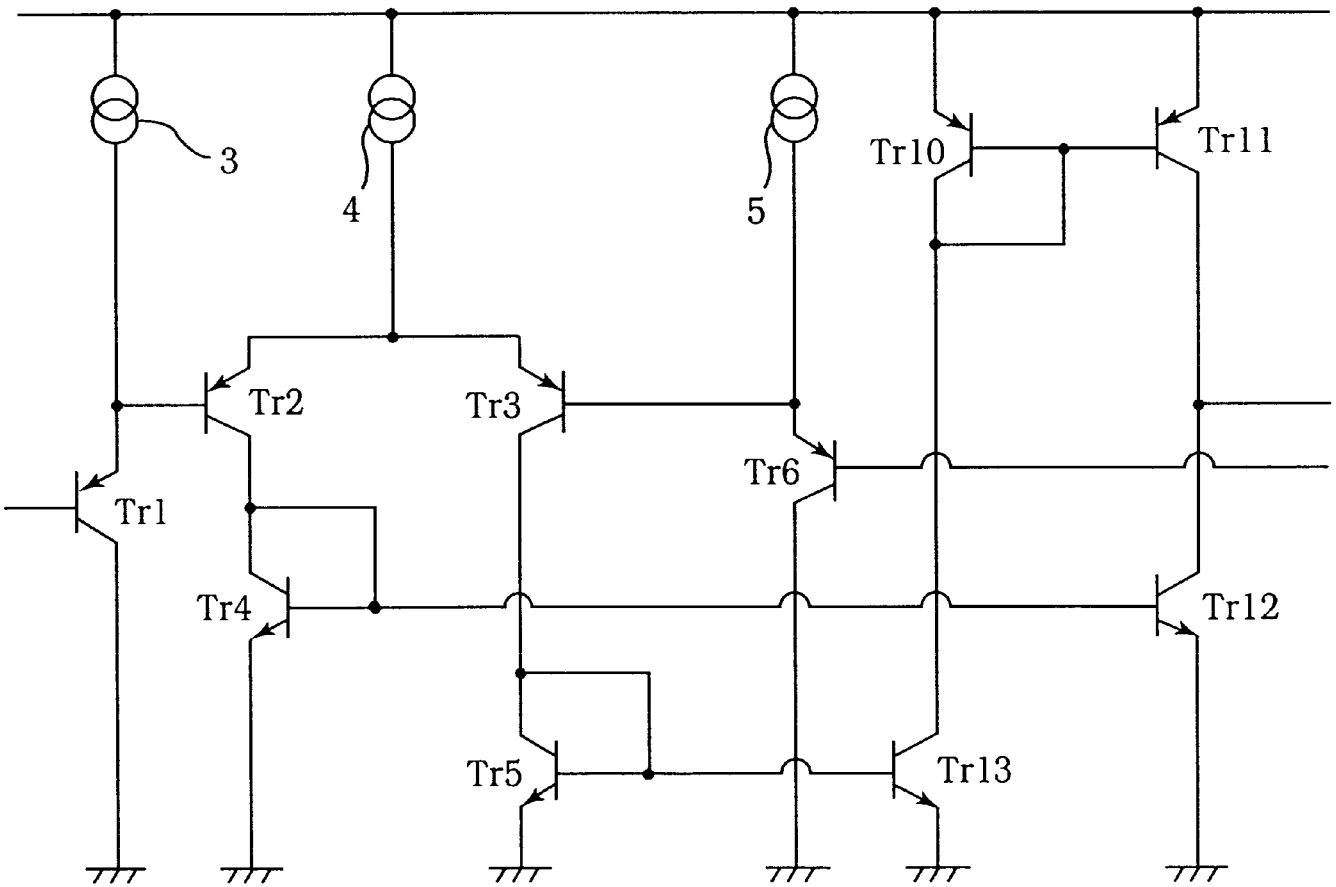
FIG. 5 is a circuit diagram showing an example of the internal configuration of the comparator.

However, the comparator may be configured in any other manner than as specifically shown in those figures; for example, it may be configured as shown in FIG. 5. Now, the comparator configured as shown in FIG. 5 will be described. In the comparator shown in FIG. 5, such circuit elements as are used for the same purposes as in the comparator shown in FIG. 1 or 3 are identified with the same reference numerals or symbols, and their detailed explanations will not be repeated. The comparator shown in FIG. 5 is a modified version of a comparator composed of constant-current sources 3, 4, and 5, pnp-type transistors Tr1, Tr2, Tr3, and Tr6, and npn-type transistors Tr4 and Tr5. Specifically, the modification consists in providing this comparator additionally with pnp-type transistors Tr10 and Tr11 receiving at their emitters the supply voltage Vcc (see FIG. 1 or 3) through the switch 2 (see FIG. 1 or 3), an npn-type transistor Tr12 having its base connected to the base and collector of the transistor Tr4, and an npn-type transistor Tr13 having its base connected to the base and collector of the transistor Tr5.

In the comparator shown in FIG. 5, unlike the comparator 11 shown in FIG. 1 or 3, the bases of the transistors Tr4 and Tr5 are not connected together. Moreover, the transistors Tr12 and Tr13 have their emitters grounded, the transistors Tr10 and Tr13 have their collectors connected together, and the transistors Tr11 and Tr12 have their collectors connected together. Moreover, the transistor Tr10 has its base and collector connected to the base of the transistor Tr11 In this way, the pair of the transistors Tr4 and Tr12, the pair of the transistors Tr5 and Tr13, and the pair of the transistors Tr10 and Tr11 each constitute a current mirror circuit.

In the comparator shown in FIG. 5, as in the comparator 11 shown in FIG. 1 or 3, the base of the transistor Tr1 serves as a non-inverting input terminal, and the transistor Tr6 serves as an inverting input terminal. Moreover, the node between the collectors of the transistors Tr11 and Tr12 serves as an output terminal, and the transistor Tr7 (see FIG. 1 or 3) has its base connected to this node between the collectors of the transistors Tr11 and Tr12.

In this comparator configured as described above, when the voltage fed to the base of the transistor Tr1 becomes higher than the voltage fed to the transistor Tr6, the emitter current of the transistor Tr3 becomes larger than the emitter current of the transistor Tr2. Since the emitter current of the transistor Tr2 is equal to the collector current of the transistor Tr4, the collector current of the transistor Tr12, which together with the transistor Tr4 forms a current mirror circuit, also is equal to those currents. Moreover, since the emitter current of the transistor Tr3 is equal to the collector current of the transistor Tr5, the collector current of the transistor Tr13, which together with the transistor Tr5 forms a current mirror circuit, also is equal to those currents.

Furthermore, since the emitter current of the transistor Tr10 is equal to the collector current of the transistor Tr13, the collector current of the transistor Tr10 and the collector current of the transistor Tr11, which together with the transistor Tr10 forms a current mirror circuit, are equal to the emitter current of the transistor Tr3. As a result, the emitter current of the transistor Tr11 becomes larger than the collector current of the transistor Tr12, and thus the comparator shown in FIG. 5 outputs a current, causing a base current to flow in the transistor Tr7 (see FIG. 1 or 3).

INDUSTRIAL APPLICABILITY

According to the present invention, in a power supply device, the voltage fed to a comparator is increased gradually, and in addition a soft starting circuit is provided that shuts off a reference voltage until the voltage fed to the comparator exceeds a predetermined voltage. This eliminates abrupt changes in the comparison output from the comparator. In this way, it is possible to reduce the start-up charge current that flows when a capacitive load is connected to the output side of the comparator, and thereby suppress a drop in the comparison output. Moreover, if the power supply device is formed as a single-chip semiconductor integrated circuit device to which a capacitor is fitted externally, it is possible to vary the capacitance of the capacitor and thereby adjust the magnitude of the start-up up charge current.

What is claimed is:

1. A power supply device that controls an output voltage from an output circuit by comparing a monitoring voltage, which is obtained by dividing the output voltage, with a reference voltage by means of a comparator and keeping the monitoring voltage equal to the reference voltage on a basis of a comparison output from the comparator, wherein as the comparator receives the monitoring voltage and the reference voltage respectively, and further receives, as a control voltage, a voltage varying according to a start-up charge voltage that is so produced as to increase gradually by a soft starting circuit when the power supply device is started up, the power supply device operates in such a way that, until the voltage varying according to the start-up charge voltage reaches a predetermined voltage equal to or higher than the reference voltage, the output voltage is produced according to the start-up charge voltage and that, after the voltage varying according to the start-up charge voltage has reached the predetermined voltage, the monitoring voltage is kept equal to the reference voltage.

2. A power supply device as claimed in claim 1, wherein the comparator comprises:

first, second, and third constant-current sources to which a first voltage is applied;

a first transistor having an emitter thereof connected to the first constant-current source and receiving at a base thereof the reference voltage;

a second transistor having a base thereof connected to the emitter of the first transistor and having an emitter thereof connected to the second constant-current source;

a third transistor having an emitter thereof connected to the second constant-current source; and a fourth transistor having an emitter thereof connected to the third constant-current source and to a base of the third transistor and receiving at a base thereof the monitor voltage obtained by dividing the output voltage from the output circuit, wherein the comparison output is fed from a collector of the third transistor to the output circuit.

3. A power supply device as claimed in claim 2, wherein the soft starting circuit is composed of:

the first constant-current source; and a capacitor having one end thereof connected to a node between the emitter of the first transistor and the base of the second transistor and receiving at another end thereof the second voltage.

4. A power supply device as claimed in claim 3, wherein the power supply device is formed as a single-chip semiconductor integrated circuit device.

5. A power supply device as claimed in claim 4, wherein a charge time is so determined that an output current at start-up is not more than ten times as large as an output current in steady-state operation.

6. A power supply device as claimed in claim 3, wherein the capacitor is fitted externally and an entire circuit of the power supply device excluding the capacitor is formed as a single-chip semiconductor integrated circuit device.

7. A power supply device as claimed in claim 3, wherein the comparator further comprises:

a sixth transistor having a collector and a base thereof connected to a collector of the second transistor and receiving at an emitter thereof the second voltage; and a seventh transistor having a collector thereof connected to the collector of the third transistor, having a base thereof connected to the base of the sixth transistor, and receiving at an emitter thereof the second voltage, and wherein the power supply device further comprises:

a discharge circuit for discharging and thereby initializing the capacitor when operation of the power supply device is stopped.

8. A power supply device as claimed in claim 7, wherein the power supply device is formed as a single-chip semiconductor integrated circuit device.

9. A power supply device as claimed in claim 8, wherein a charge time is so determined that an output current at start-up is not more than ten times as large as an output current in steady-state operation.

10. A power supply device as claimed in claim 7, wherein the capacitor is fitted externally and an entire circuit of the power supply device excluding the capacitor is formed as a single-chip semiconductor integrated circuit device.

11. A power supply device as claimed in claim 2, wherein the soft starting circuit is composed of:

a fourth constant-current source to which the first voltage is applied;

a capacitor having one end thereof connected to the fourth constant-current source and receiving at another end thereof the second voltage;

a fifth transistor having an emitter thereof connected to the emitter of the first transistor, having a base thereof connected to a node between the capacitor and the fourth constant-current source, and receiving at a collector thereof the second voltage; and a clamp circuit, connected between the base of the first transistor and the base of the fifth transistor, for limiting a voltage at the base of the fifth transistor so that the voltage at the base of the fifth transistor does not become higher than a predetermined voltage.

12. A power supply device as claimed in claim 11, wherein the power supply device is formed as a single-chip semiconductor integrated circuit device.

13. A power supply device as claimed in claim 12, wherein a charge time is so determined that an output current at start-up is not more than ten times as large as an output current in steady-state operation.

14. A power supply device as claimed in claim 11, wherein the capacitor is fitted externally and an entire circuit of the power supply device excluding the capacitor is formed as a single-chip semiconductor integrated circuit device.

15. A power supply device as claimed in claim 11, wherein the comparator further comprises:

a sixth transistor having a collector and a base thereof connected to a collector of the second transistor and receiving at an emitter thereof the second voltage; and a seventh transistor having a collector thereof connected to the collector of the third transistor, having a base thereof connected to the base of the sixth transistor, and receiving at an emitter thereof the second voltage, and wherein the power supply device further comprises:

a discharge circuit for discharging and thereby initializing the capacitor when operation of the power supply device is stopped.

16. A power supply device as claimed in claim 15, wherein the power supply device is formed as a single-chip semiconductor integrated circuit device.

17. A power supply device as claimed in claim 16, wherein a charge time is so determined that an output current at start-up is not more than ten times as large as an output current in steady-state operation.

18. A power supply device as claimed in claim 15, wherein the capacitor is fitted externally and an entire circuit of the power supply device excluding the capacitor is formed as a single-chip semiconductor integrated circuit device.

19. A power supply device as claimed in claim 1, wherein the soft starting circuit includes a clamp circuit for shortening a charge time required to discharge and thereby initialize the capacitor.

* * * * *